US007418848B2

(12) United States Patent
Im

(10) Patent No.: US 7,418,848 B2
(45) Date of Patent: Sep. 2, 2008

(54) HIGH-PERFORMANCE AND HIGH-EFFICIENCY ROLLED FIN TUBE AND FORMING DISK THEREFOR

(75) Inventor: Kwan Ho Im, Chicago, IL (US)

(73) Assignee: Fin Tube Technology Co., Ltd., Chungcheongnam-do (KR)

( * ) Notice: Subject to any disclaimer, the term of this patent is extended or adjusted under 35 U.S.C. 154(b) by 0 days.

(21) Appl. No.: 11/581,209

(22) Filed: Oct. 13, 2006

(65) Prior Publication Data

US 2007/0113609 A1 May 24, 2007

Related U.S. Application Data

(63) Continuation-in-part of application No. 11/125,049, filed on May 9, 2005.

(30) Foreign Application Priority Data

Jun. 4, 2004 (KR) ..... 10-2004-0040949

(51) Int. Cl.
*B21D 3/00* (2006.01)

(52) U.S. Cl. ..... 72/78; 72/77; 72/98; 72/370.16

(58) Field of Classification Search ..... 72/77, 72/78, 95, 98, 102, 107, 370.16
See application file for complete search history.

(56) References Cited

U.S. PATENT DOCUMENTS 2,429,491 A * 10/1947 Schuler ..... 492/1
2,779,223 A * 1/1957 Schuster ..... 72/100
2,983,171 A * 5/1961 Laban ..... 72/107
3,064,506 A * 11/1962 Nihlen et al. ..... 72/98
3,383,893 A * 5/1968 Counts ..... 72/98
4,100,784 A * 7/1978 Thomas ..... 72/98
4,538,677 A * 9/1985 Bodas et al. ..... 165/146
4,612,791 A * 9/1986 Przybyla et al. ..... 72/98
4,915,166 A * 4/1990 Cunningham et al. ..... 165/184
7,197,808 B2 * 4/2007 Zimprich ..... 29/458

* cited by examiner

*Primary Examiner*—Edward Tolan
(74) *Attorney, Agent, or Firm*—Greenberg Traurig, LLP

(57) ABSTRACT

Disclosed herein is a forming disk for fabricating a fin tube. The forming disk comprises a substantially circular plate having a shaft connection hole formed adjacent a center thereof for receiving a shaft of a form rolling machine. A plurality of projections having a first length are formed along a circumference of said plate at substantially regular angular intervals in such a way as to protrude in a radial direction, and a round curvature is formed in the formed fin at certain axial pitch periodically in a radial direction. Also disclosed is a high-performance and high-efficiency fin tube having formed fins. Each formed fin comprises a generally circular plate having a crest and a valley formed in both side faces at certain angular intervals along the circumference thereof so as to form a continuous curvature.

5 Claims, 11 Drawing Sheets

HIGH-PERFORMANCE AND HIGH-EFFICIENCY ROLLED FIN TUBE AND FORMING DISK THEREFOR

CROSS-REFERENCE TO RELATED APPLICATION

This application is a continuation-in-part of U.S. patent application Ser. No. 11/125,049, filed May 9, 2005, the disclosure of which is incorporated herein by reference in its entirety for all purposes.

BACKGROUND OF THE INVENTION

1. Field of the Invention

The present invention relates to a high-performance and high-efficiency fin tube for a heat-exchanger and a forming disk for fabricating the same.

2. Background of the Related Art

A fin tube is a tube where prominent and depressed portions are formed alternately on the outer peripheral surface of the tube along the longitudinal direction thereof, in order to facilitate the heat transfer of the tube, through which a fluid passes. In this fin tube, due to the extended area of the outer surface, an efficient heat transfer can be carried out between a heat medium positioned outside the tube and a heat transfer medium flowing inside the tube.

Therefore, these fin tubes are mainly utilized in a heat exchanger, and ceaseless efforts have been made in order to achieve a high-performance and high-efficiency heat exchanger.

In the case where a liquid flows inside a tube and a gas flows outside the tube, a heat transfer coefficient outside the tube is very small relative to the heat transfer coefficient inside of the tube. The ratio between the heat transfer coefficients is approximately less than one twentieth (1/20). This means that the heat transfer resistance outside the tube, where a gas flows, is above 20 times that inside the tube. In order to reduce the outside heat transfer resistance, a fin is attached outside the tube to thereby increase the area for heat transferring.

The present invention relates to a change in the shape of fin in order to increase the heat transfer coefficient, i.e., the surface of the flat rolled fin is made to be curved to thereby increase its heat transfer coefficient. A basic concept therefore is disclosed in Korean Utility Model Registration No. 20-200314025 (registered on May 9, 2003). In the present invention, however, a fin tube having an optimum structure and conditions for increasing heat transfer is disclosed. Also, a forming disk for form-rolling this fin tube is disclosed. That is, the present invention relates to a second-generation technology for further developing and implementing the concept disclosed in the above registered utility model.

SUMMARY OF THE INVENTION

Therefore, the present invention has been made in view of the above problems, and it is an object of the present invention to provide a fin tube having a structure in which the heat transfer coefficient is increased while the pressure loss is not increased so much. A confirmation experiment has been performed and its data is presented along with explanation on an optimum condition. In addition, a method of fabricating the fin tube is explained.

To accomplish the above object, according to one aspect of the present invention, there is provided a forming disk for fabricating a formed fin of a fin tube using a common type form rolling machine. The fin tube is applied to a heat exchanger. The forming disk is formed of a circular plate having a shaft connection hole penetratingly formed at the center thereof for being connected to a shaft of the form rolling machine. A projection having a certain length is formed along the circumference thereof at certain regular angular intervals in such a way as to be protruded in a radial direction. A round curvature is formed in the formed fin at certain axial pitch periodically in a radial direction.

The projection of the forming disk has a lowest height at the outermost portion of the forming disk and the height increases gradually toward the inside thereof.

The projections are disposed in such a way that a pair of projections are positioned in an alternate pattern.

The forming disk may be formed of two pieces, which are separately fabricated and combined.

According to another aspect of the invention, there is provided a high-performance and high-efficiency fin tube including a tube and a formed fin formed at the outer peripheral surface thereof. The formed fin is formed of a generally circular plate, and having a crest and a valley formed in both side faces at certain angular intervals along the circumference thereof so as to form a continuous curvature.

The height and depth of the crest and the valley are symmetrically constructed.

The crest and the valley are formed in such a manner that it is formed starting from a certain position apart from the outer peripheral face of the tube and has a maximum height and depth at the outermost thereof.

The crest and the valley are formed in an obtuse arcuate shape.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

The preferred embodiments of the invention will be hereafter described in detail, with reference to the accompanying drawings.

First, the term "high performance" used herein means that the heat transfer coefficient is high. The term "high efficiency" used herein means that, when a gas flows along the outer surface of a fin tube, the heat transfer rate is highly increased, but the pressure loss is not highly increased, as compared with a conventional flat fin tube, so that a heat exchanger formed of a fin tube of the invention requires less power for blowing.

Figure 1:
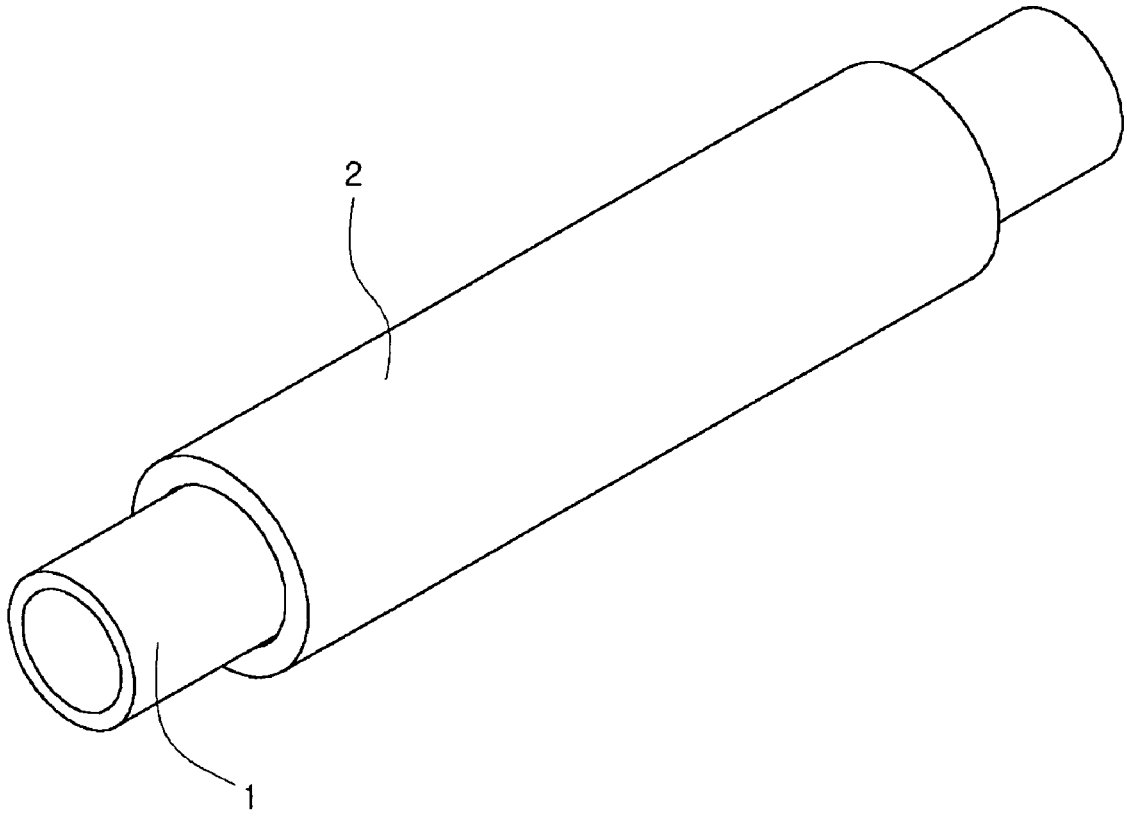
FIG. 1 is a perspective view showing a bare tube and an aluminum tube combined therewith for fabricating a fin tube according to the present invention.
Figure 2:
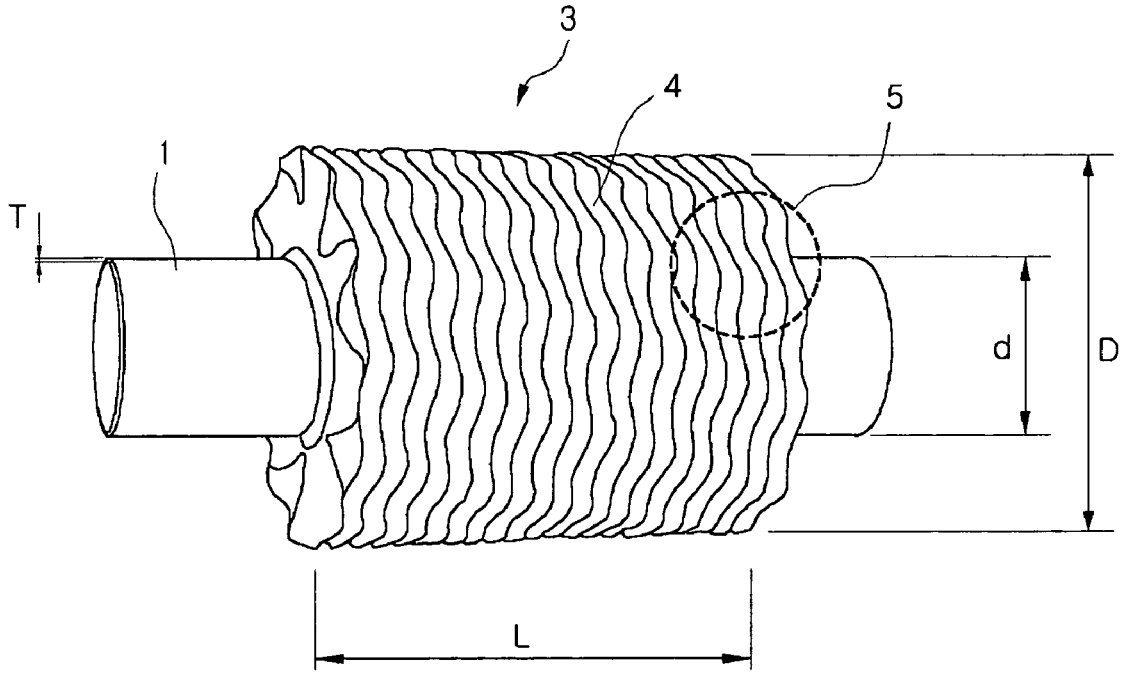
FIG. 2 is a perspective view showing a fin tube according to the invention.

FIG. 2 shows a high-performance and high-efficiency fin tube 3 according to the invention. This fin tube 3 is fabricated using a well-known method of manufacturing a flat rolled fin, after a metallic bare tube 1 is inserted into, for example, an aluminum tube 2 having a good heat conductivity, as shown in FIG. 1. However, the fin forming disk for forming the fin is different from that of the flat disk.

Figure 3:
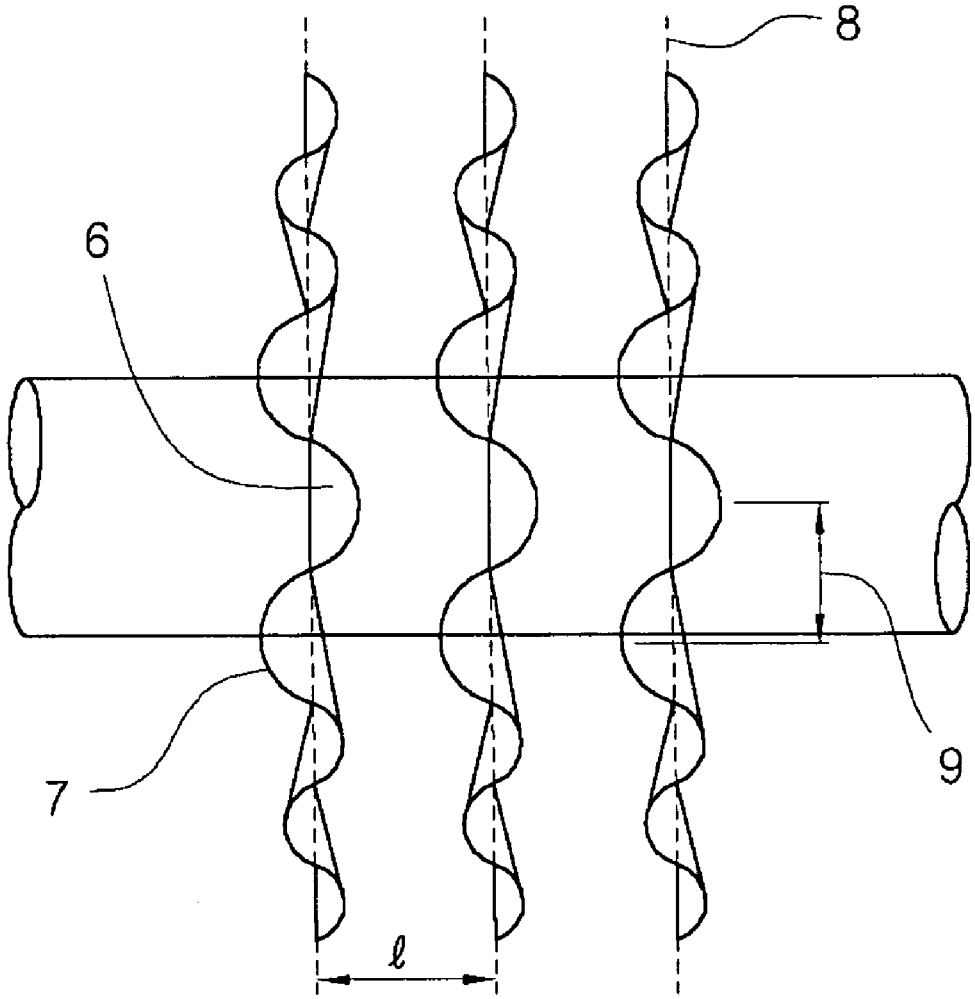
FIG. 3 is a front view of a fin tube according to the invention.
Figure 4A:
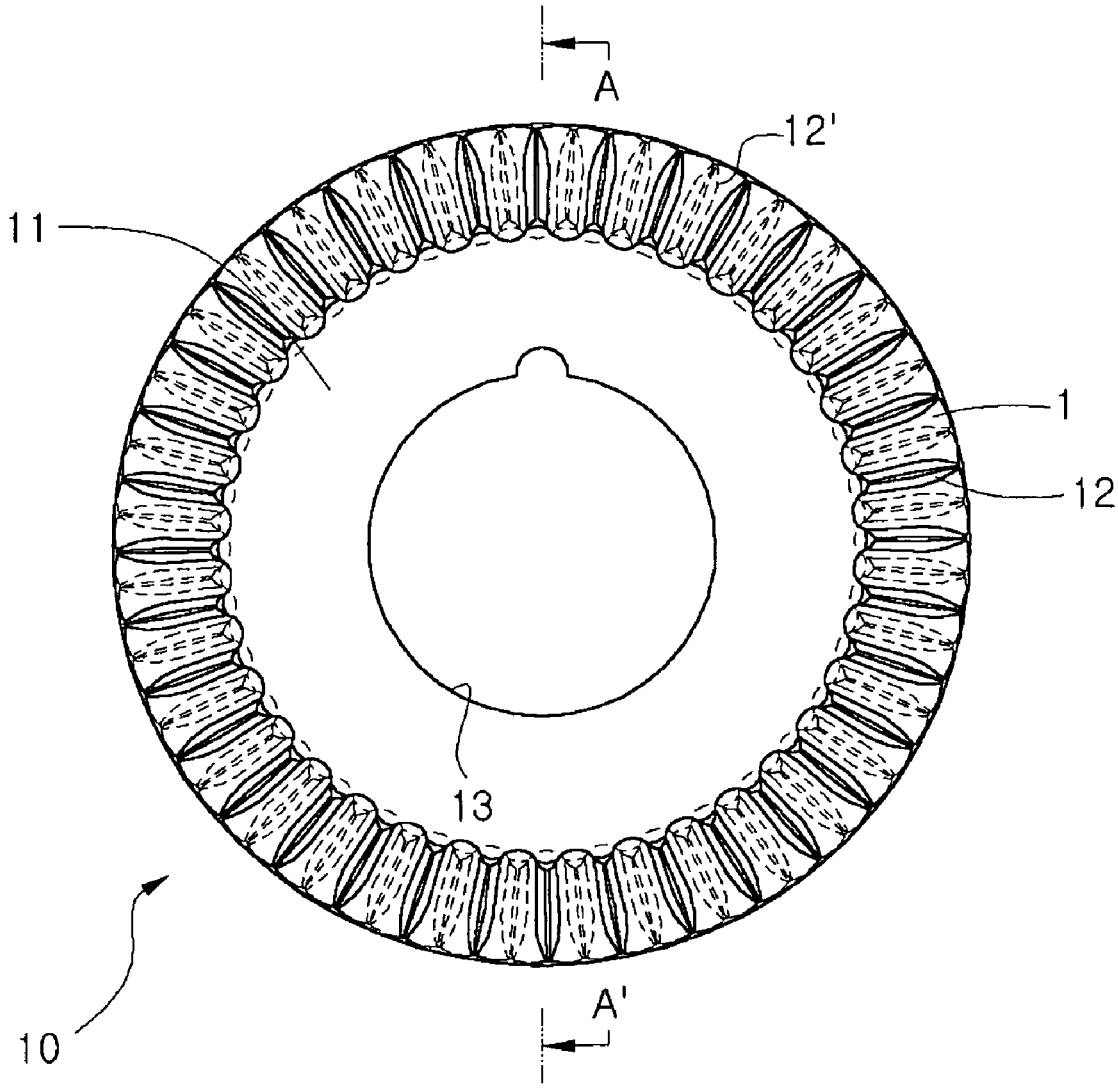
FIG. 4*a* is a front view of a pair of forming disks for fabricating a fin tube according to the invention.
Figure 4B:
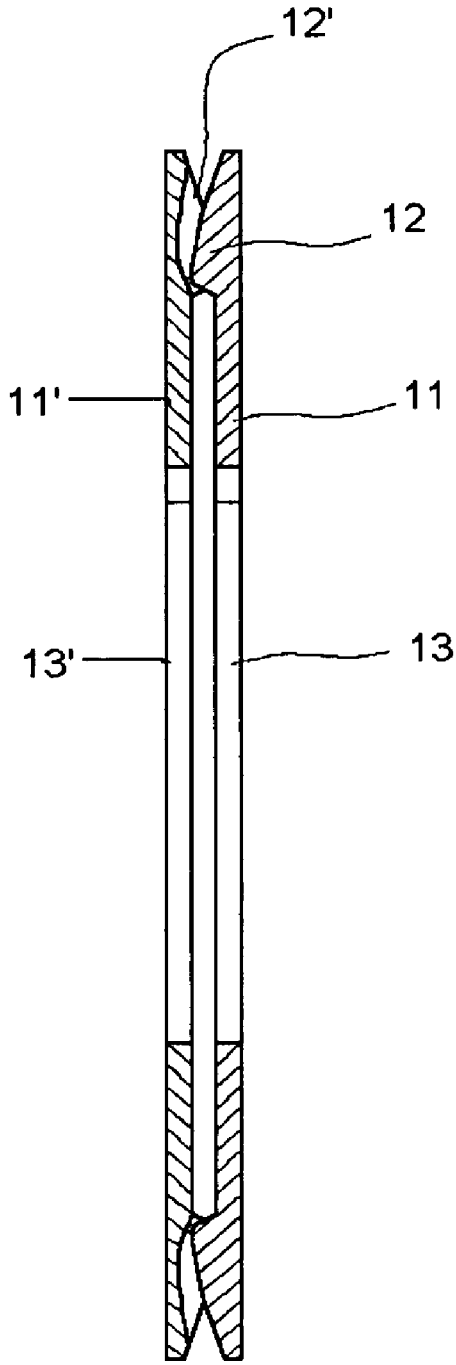
FIG. 4*b* is a cross-section taken along the line A-A' in FIG. 4*a;*
Figure 5A:
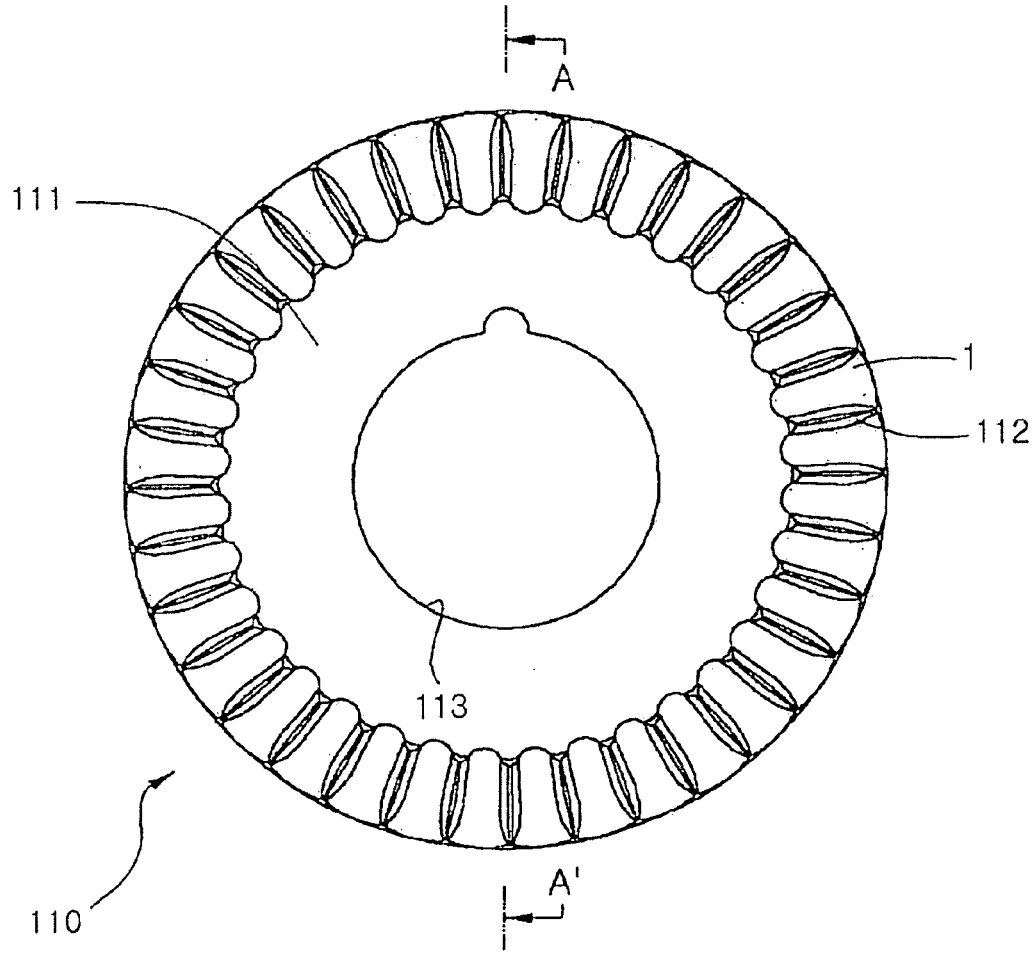
FIG. 5*a* is a front view of a forming disk for fabricating a fin tube according to the invention.
Figure 5B:
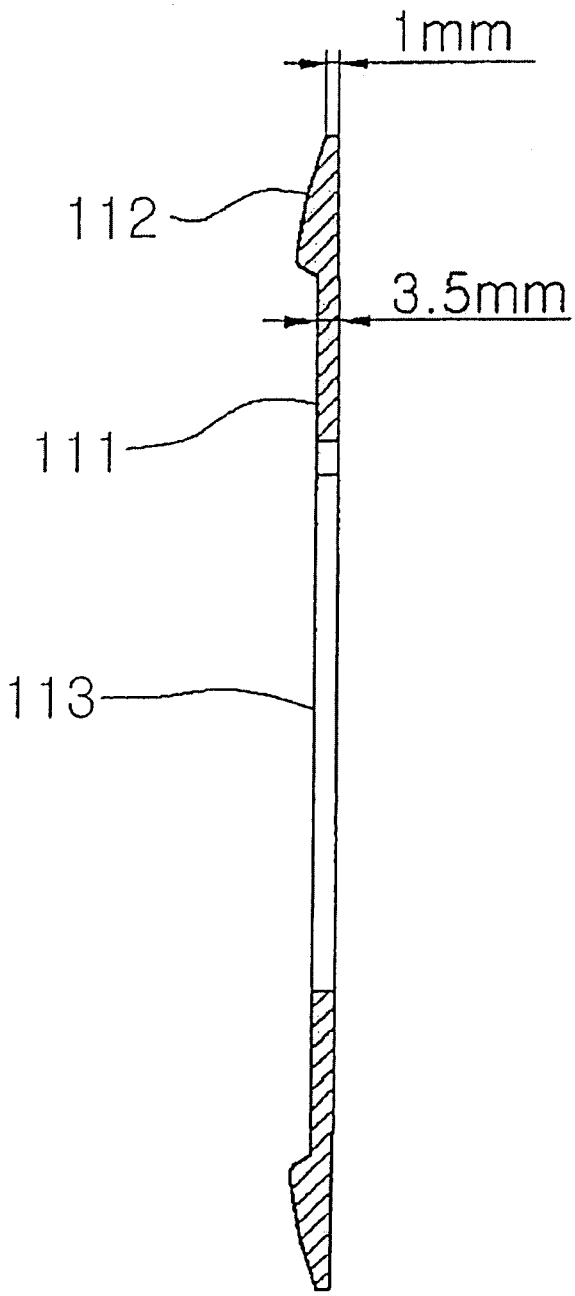
FIG. 5*b* is a cross-section taken along the line A-A' in FIG. 5*a;*

The fin forming disk for fabricating a flat rolled fin tube is structured of a plane form, but in order to manufacture a high-performance and high-efficiency fin tube 3, a pair of forming disks 10 as shown in FIGS. 4*a* and 4*b* or a forming disk 110 as shown in FIGS. 5*a* and 5*b* is used. An optimum curvature pattern for a "high-performance and high-efficiency fin tube" 3 is a symmetric structure where a crest 7 and a valley 6 is continuously repeated. The curvatured pattern is in the shape of a circular arc, as shown in FIG. 3. Here, the crest 7 means a prominence, and the valley means a depression.

The curvature is formed of a round-shape one above and below the horizontal line of symmetry depicted by a dotted line 8. The horizontal distance 9 between the valley 6 and the crest 7 has a maximum value at the end of a formed fin 4 and the distance becomes smaller gradually towards the surface of the fin tube 3. The speed of fluid is at the maximum at a position of about 0.1 mm from the outer peripheral surface of the bare tube 1, and the speed is maintained at a high level up to around 2 mm from the outer peripheral surface thereof. Therefore, in this area, if a curvature is formed on the outer surface of the formed fin 4, the heat transfer coefficient is increased less, relatively to a high increase in the pressure loss.

For these reasons, a high-performance and high-efficiency fin tube 3 has a condition in which it is formed of a flat fin at the position having a maximum fluid speed.

In order to become a high-performance and high-efficiency fin tube 3, the crest 7 and the valley 6 are preferred to be formed in as round a shape as possible. In this way, in the case where the fluid flows along the spaces between the formed fins 4, when the fluid flows toward the crest 7, an attached flow at the windward face is increased. Also, when the fluid flows along a leeward face towards the valley 6 after the crest 7, the attached flow is maintained as long as possible.

While the fluid flows towards the crest 7, it flows in such a way as to impinge against a wall, thereby increasing the amount of attached flow and thus maximizing the heat transfer coefficient. In the leeward face of the crest 7, the boundary layer of the fluid is rapidly increased and its speed is further decreased, thus forming a separated flow to thereby form a strong vortex and decrease the heat transfer coefficient. However, if the speed of fluid is increased, the flow of a fluid can become an attached flow, and thus, the total heat transfer coefficient is further increased.

FIG. 4*a* is a front view of a pair of forming disks 10 for fabricating a high-performance and high-efficiency fin tube 3, and FIG. 4*b* is a cross-sectional view taken along the line A-A' in FIG. 4*a*.

As shown in FIGS. 4*a* and 4*b*, on a plane 11 is formed periodically a pair of projections 12 and 12' disposed in an alternate fashion. In the center of the pair of forming disks 10 is penetratingly formed circular shaft connection holes 13 and 13', through which the shaft of a known rolled fin forming machine is to be inserted. The height of the projections 12 and 12' is made to be 1 mm at the end of the disk 10 and 3.5 mm at the end of the projections 12 and 12'. These values vary with the distance l between the fins. In addition, the shape of the projections 12 and 12' is made so as not to form a sharp edge. In this embodiment, the pair of forming disks 10 is constructed in such a way that two pieces face each other at the predetermined distance and the projections are positioned in an alternate pattern. Although the combined forming disk 10 is constructed in such a way as to be divided into two pieces, it may be integrally formed in a single piece.

FIG. 5*a* is a front view of a forming disk 110 for fabricating a high-performance and high-efficiency fin tube 3, and FIG. 5*b* is a cross-sectional view taken along the line A-A' in FIG. 5*a*.

As shown in FIGS. 5*a* and 5*b*, projections 112 are formed on a plane 111. In the center of the forming disk 110 is penetratingly formed a circular shaft connection hole 113, through which the shaft of a known rolled fin forming machine is to be inserted. The height of the projections 112 is made to be 1 mm at the end of the disk 110 and 3.5 mm at the end of the projections 112. These values vary with the distance l between the fins. In addition, the shape of the projections 112 is made so as not to form a sharp edge. In this embodiment, the forming disk 110 is constructed as a single piece.

EXAMPLE

In this example, an experiment was carried out in order to find out how much the heat transfer coefficient of a high-performance and high-efficiency fin tube is increased, as compared with a conventional flat fin tube. The experimental equipment is composed of a boiler for heating water using an electric heater, a heat exchanger, an air blower, a flow meter, a speedometer for measuring the air speed, and twelve (12) thermocouples. Between the upstream of the heat exchanger and the air blower is installed a honeycomb, the size of which is small, but which has the form of a wind tunnel.

In the fin tube 3, the length L of a formed fin (the portion having a formed fin) is 200 mm, the outer diameter of the bare tube d is 25.4 mm, the thickness of the bare tube T is 2.77 mm, the distance between the fluid flow and the vertical center of the tube is 63 mm, the outer diameter D of the fin tube is 57 mm, the thickness of root portion of a fin is 0.8 mm, and the thickness of end portion of a fin is 0.2 mm. The fin pitch P has a length of 200 mm and is eight in number.

Figure 6A:
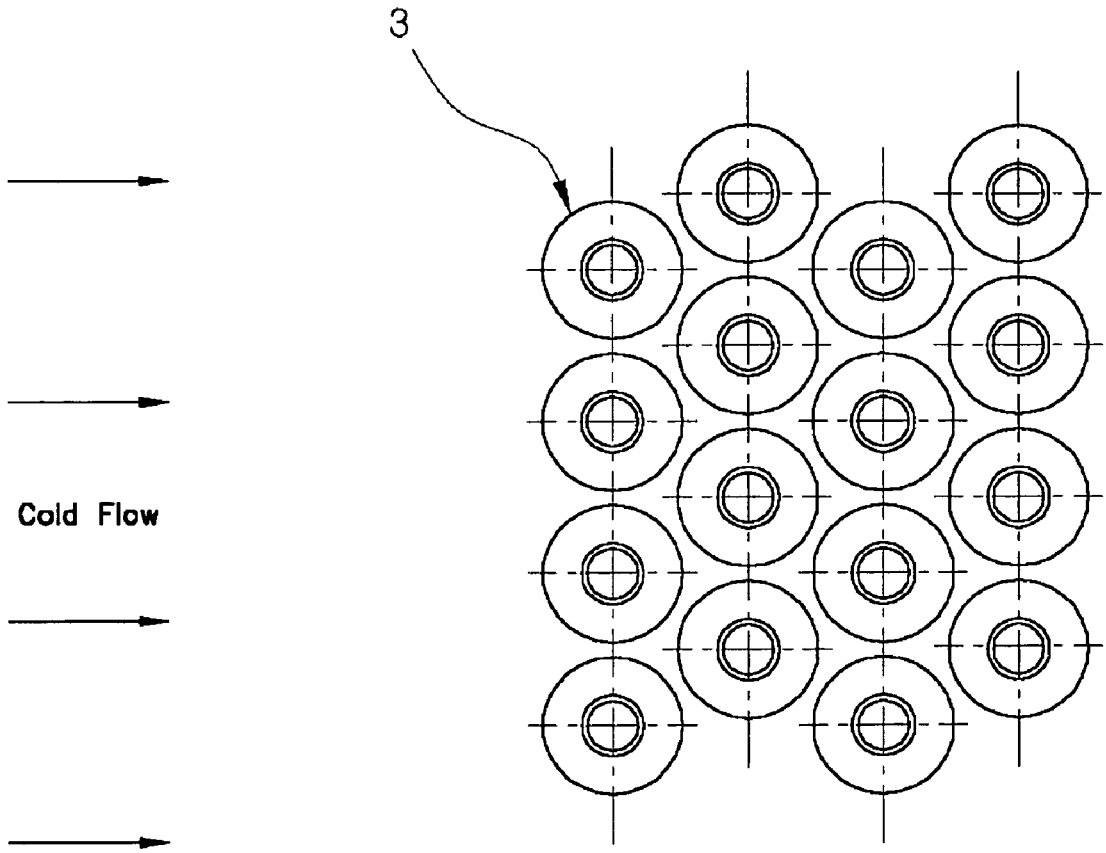
FIG. 6*a* is an arrangement of fin tubes for testing the performance of a fin tube according to the invention.
Figure 6B:
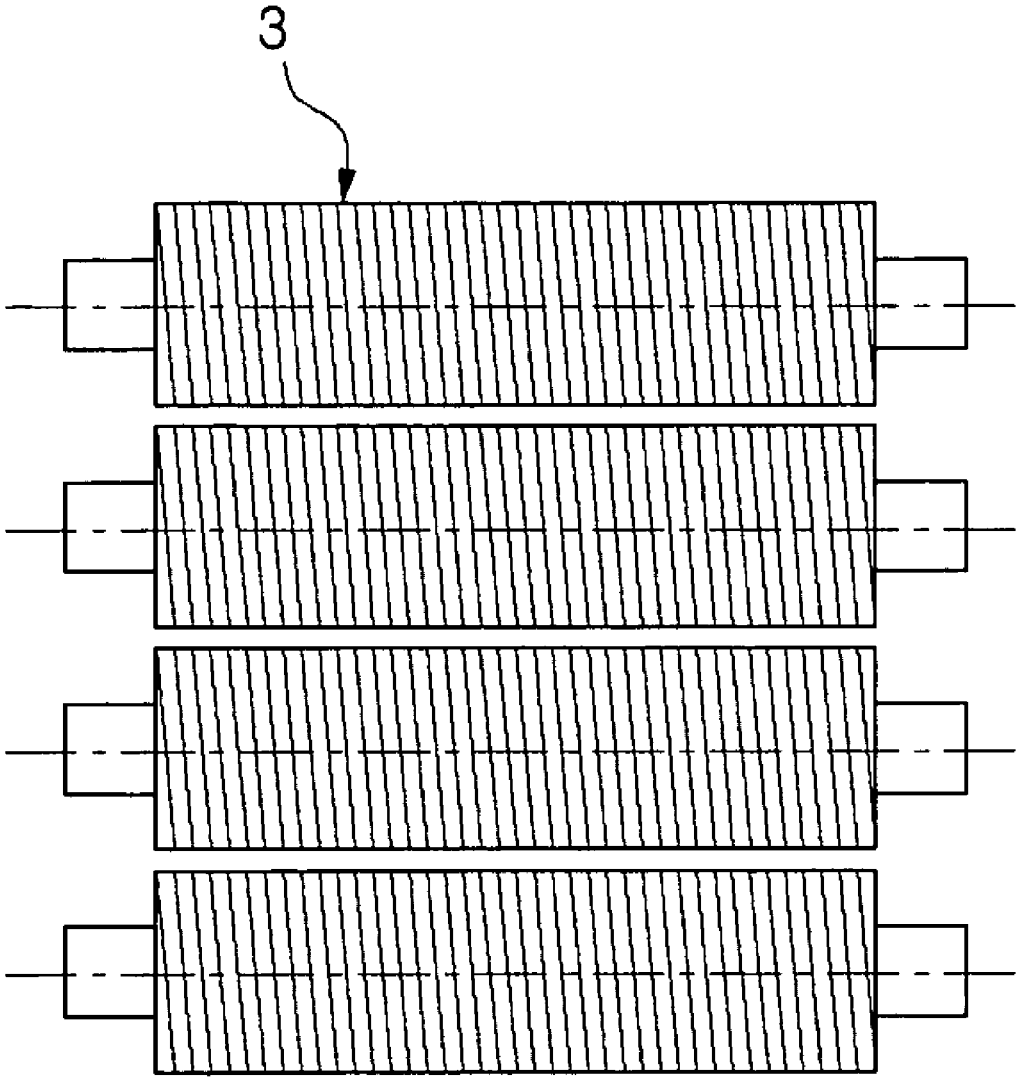
FIG. 6*b* is a side view of FIG. 6*a;*

A pilot scale heat exchanger is constructed using this high-performance and high-efficiency fin tube 3. Four fin tubes constitutes one column perpendicularly to the fluid and four (4) columns are constructed, thus being constituted of total 16 fin tubes. FIGS. 6*a* and 6*b* show a specific arrangement of fin tubes. Water of 50° C. enters the heat exchanger through two columns at the rear end of the heat exchanger, and exits through two columns at the front end of the heat exchanger. Two thermocouples were used to measure the water temperatures at the entrance and exit of the tube. The flow meter was used to measure the flow rate of the water. The entrance temperature of air was measured using one thermocouple, and the exit temperature of air was measured using nine (9) thermocouples and averaged to obtain the exit temperature value of air. The flow rate of air was measured using an air volume meter (speedometer).

The heat transfer coefficient inside the tube was obtained using a well-known correlation analysis. The above measurement values were used to obtain the heat transfer coefficient at the air side.

Figure 7:
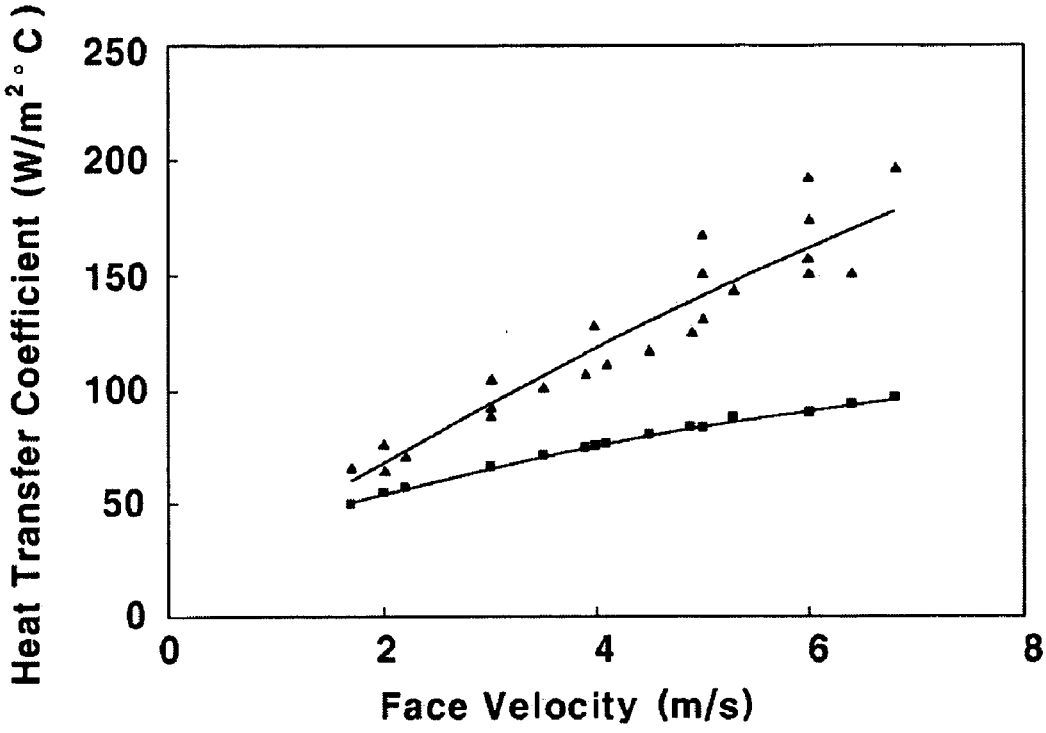
FIG. 7 is a graph showing the heat transfer coefficient of a fin tube according to the invention.

The measured results are presented in FIG. 7. The transverse axis (x-axis) represents an average speed (face speed) at which air enters the heat exchanger. This value is obtained by dividing the flow rate of air by the area of the plane of the heat exchanger. The longitudinal axis (y-axis) represents the heat transfer coefficient. In the graph of FIG. 7, the values on the upper line are the heat transfer coefficients of the high-performance and high-efficiency fin tube 3, and the values on the lower line are the heat transfer coefficients of the conventional flat fin tube. The values on the lower curve are one obtained by using a correlation, which is widely used in a commercial computer program, but not the measured ones. As can be seen from the graph that the heat transfer coefficient of a high-performance and high-efficiency fin tube 3 is around 10% higher than that of the conventional flat fin tube at a low air speed, and the difference in the heat transfer coefficient becomes larger as the air speed increases.

Figure 8:
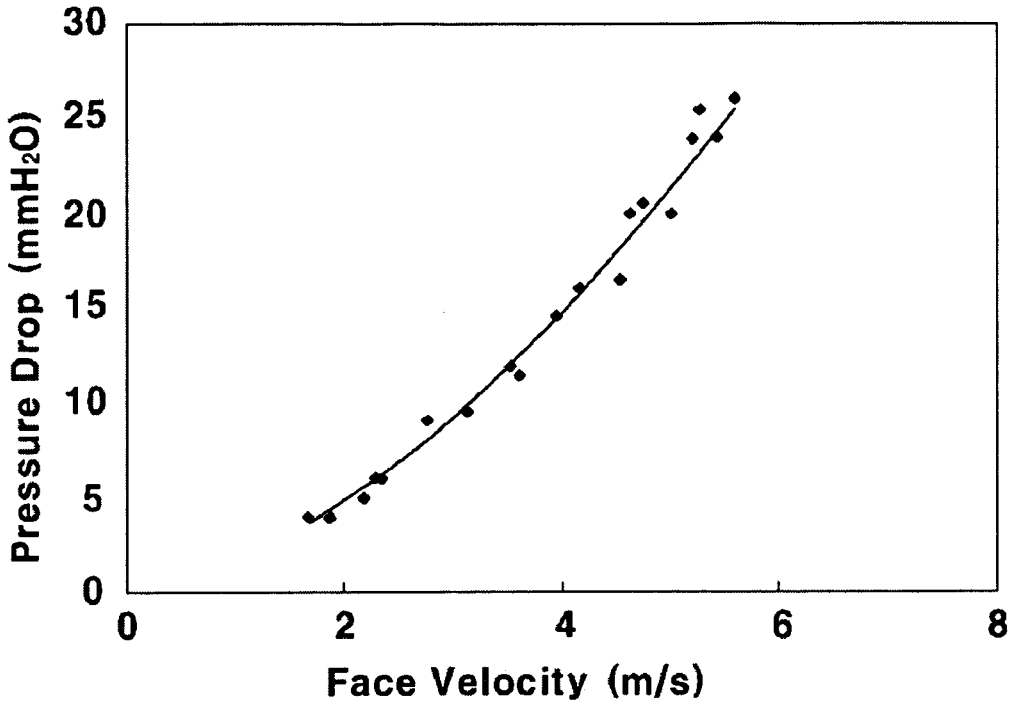
FIG. 8 is a graph showing the pressure drop of a fin tube according to the invention.

As shown in the graph, as the air speed increases from 1.7 m/s to 6 m/s, the heat transfer coefficient is increased from 10% up to 150%, but the pressure loss is increased from 5% up to 29% at the maximum. The measured pressure loss is presented in FIG. 8. Consequently, it has been found that the more the speed increases, the more the heat transfer coefficient of the high-performance and high-efficiency fin tube 3 increases. However, the pressure increases relatively less.

As described above, the heat exchanger fabricated using the high-performance and high-efficiency fin tubes of the invention has a smaller size, but does not increase the power of the air blower. Therefore, it is favorable, in terms of the initial investment prices. In addition, the present invention can be widely applied to the air-cooled heat exchanger in a petrochemical plant, the air-cooled heat exchanger in an oil refinery, an air-cooled vacuum condenser in a power plant, an air-cooled condenser in an incinerator, and an exterior heat exchanger in a refrigerating machine.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A forming disk for fabricating a fin tube applied to a heat exchanger, comprising a substantially circular plate having a shaft connection hole formed therein for receiving a shaft of a form rolling machine, said plate having first and second substantially planar surfaces which are located opposite from one another, said connection hole extending through said first and second planar surfaces, said second planar surface being spaced from said first planar surface in a lateral direction which is substantially parallel to an axis of rotation of said plate; and a plurality of projections arranged on said second planar surface along a circumference of said plate at substantially regular angular intervals, each of said projections protruding outwardly from said second planar surface in said lateral direction away from said first surface.

2. The forming disk according to claim 1, wherein the projections are disposed in such a way that a pair of projections are positioned in an alternate pattern.

3. The forming disk according to claim 1, wherein the pair of projections have a lowest height at the outermost portion of the forming disk, and their heights increase gradually toward the inside thereof.

4. The forming disk according to claim 3, wherein the projections are disposed in such a way that a pair of projections are positioned in an alternate pattern.

5. The forming disk according to claim 1, wherein the forming disk is formed of two pieces, which are separately fabricated and combined.

* * * * *